United States Patent [19]

Slattery

[11] Patent Number: 4,826,459

[45] Date of Patent: May 2, 1989

[54] TILT MECHANISM FOR OUTBOARD MOTORS

[75] Inventor: Gordon C. Slattery, Omro, Wis.

[73] Assignee: Brunswick Corporation, Skokie, Ill.

[21] Appl. No.: 178,564

[22] Filed: Apr. 7, 1988

[51] Int. Cl.[4] ..... B63H 5/06

[52] U.S. Cl. ..... 440/55; 440/63

[58] Field of Search ..... 440/53, 55, 56, 63, 440/65, 900; 248/640–643; 74/569

[56] References Cited

U.S. PATENT DOCUMENTS

| | | | |
|---|---|---|---|
| 4,331,430 | 5/1982 | Lutzke et al. | 440/53 |
| 4,472,148 | 9/1984 | Kollock et al. | 440/53 |
| 4,637,800 | 1/1987 | Slattery | 440/55 |

*Primary Examiner*—Sherman D. Basinger

*Assistant Examiner*—Jésus D. Sotelo

*Attorney, Agent, or Firm*—Andrus, Sceales, Starke & Sawall

[57] ABSTRACT

A tilt mechanism for an outboard motor includes a series of trim and shallow water operation positions which may be preset by the operator and from which the motor may be temporarily tilted up without engaging and being held in a higher tilt position. Correspondingly, elimination of the condition requiring or causing the temporary tilt-up allows direct return of the motor to the original trim position. Alternately, a manually operable trim ratchet assembly allows the operator to temporarily tilt the engine to and have it held at a higher trim position if desired. Disengagement of the trim ratchet assembly also allows direct return of the motor to the original trim position.

7 Claims, 4 Drawing Sheets

TILT MECHANISM FOR OUTBOARD MOTORS

BACKGROUND OF THE INVENTION

The present invention relates to a mechanism for tilting an outboard motor in a vertical plane relative to its mounting bracket and, more particularly, to a mechanism for providing a variety of preset tilt positions, temporary movement from and direct return to the preset position, or resetting the tilt to intermediate positions.

U.S. Pat. Nos. 4,331,430 and 4,472,148 describe similar mechanisms for providing a variety of outboard motor tilt positions. The positions typically include a series of lower trim positions, one or more shallow water drive positions, and an uppermost trailering position. These patents describe alternate mechanisms for selecting and establishing the various tilt positions and moving the motor between them. In particular, U.S. Pat. No. 4,472,148 discloses a mechanism which allows the operator to change positions simply by pushing down on the motor tiller handle and tilting the engine up. A ratchet mechanism allows stepwise movement between a trim pin and serially arranged position notches to allow the motor to be tilted from the original down position to any higher position, including the uppermost trailering position, without activating any supplemental mechanism. To bring the motor back down to the original position, and depending upon which upper position it has been temporarily moved to, the motor is tilted up to and slightly beyond the uppermost shallow water drive position or the top trailering position, and released. The trim pin follows a closed circuit cam track that returns the trim pin and motor to its original position as the engine tilts down.

Although this mechanism has operated satisfactorily, it has been found that the mechanism does not provide the most convenient operation under certain conditions commonly encountered in use. For example, if the engine trails out from the boat as a result of rapid deceleration, if the tiller handle is inadvertantly pushed down, or if the engine is tilted up purposely due to shallow water, the motor will tilt to a higher position and be held there by the mechanism. Thus, this mechanism holds the motor in a higher position which is only temporary and is not normally desired to be held. To return the motor to its original trim position, it is necessary to continue to tilt the motor up beyond the highest trim position and allow the trim pin to engage the return cam track. This action is somewhat awkward and may cause the motor propeller to come out of the water. If the engine is running while this is done, the engine exhaust outlet will be exposed and, consequently, the engine noise will not be muffled.

U.S. Pat. No. 4,472,148 also allows the operator to preset any of three lower trim positions to which the motor will return when it is tilted down, as described above. However, the mechanism has a total of five trim positions and, if the operator wishes to return the motor to the fourth or fifth trim position, the operator must preset the return to the third position, allow the motor to return directly to it via the return cam track, and then raise the motor to the desired fourth or fifth position.

SUMMARY OF THE INVENTION

The present invention corrects the operational deficiencies in the prior art mechanisms, as described above, while retaining the same basic construction with a few modifications. The mechanism of the present invention allows the operator to pivot the motor from any preset trim position temporarily to any higher position and still return directly to the original trim position. An adjustable trim stop allows the operator to select and preset any one of the five trim positions. If it is desired to tilt and temporarily hold the motor at a higher position, a selectively engageable trim ratchet may be activated to provide notch-by-notch upward rotation of the motor in the same manner as the prior art mechanism. Manual return of the trim ratchet to its inoperative position allows the operator to return the motor directly down to the original preset trim position by tilting the motor up slightly and releasing it. In addition, the uppermost trailering notch and its function are retained and operates in essentially the same manner as the prior art devices.

The present invention prevents the motor from ratcheting up and being locked in a higher trim position in the event of trailing out from deceleration, tilting up because of a temporary shallow water condition, or simple inadvertant tilt of the motor.

The tilt mechanism of the present invention includes a transom bracket having a cam track which includes a plurality of trim/shallow water notches spaced circumferentially about a first horizontal axis. A swivel bracket for carrying the outboard motor is pivotally attached to the transom bracket for rotation about the first axis. A pawl assembly, pivotally attached to the swivel bracket on a second horizontal axis, includes a free end adapted to move along the cam track and into engagement with the notches to provide a series of angular tilt positions for the swivel bracket and attached motor. An adjustable guide is movable along the cam track to establish a selected original trim position, the guide being engageable by the free end of the pawl assembly to guide it into the notch representing the selected trim position in response to downward rotation of the swivel bracket. A biasing means holds the pawl assembly in a neutral position on the cam track with the free end of the assembly out of engagement with the trim notches. This allows upward rotation of the swivel bracket past the notches for temporary upward tilting of the motor and direct downward return rotation of the swivel bracket for reengagement of the end of the pawl assembly with the notch establishing the original preset trim position. A manually operable ratchet means is attached to the transom bracket for movement into an operative position in engagement with the free end of the pawl assembly and the notches to provide sequential upward ratcheting and sequential step-wise engagement with the notches in response to rotation of the swivel bracket in an upward direction. Manual disengagement of the ratchet means allows direct return of the motor from a temporary upper trim or shallow water position to the original preset trim position.

DETAILED DESCRIPTION OF THE PREFERRED EMBODIMENTS

Figure 1:
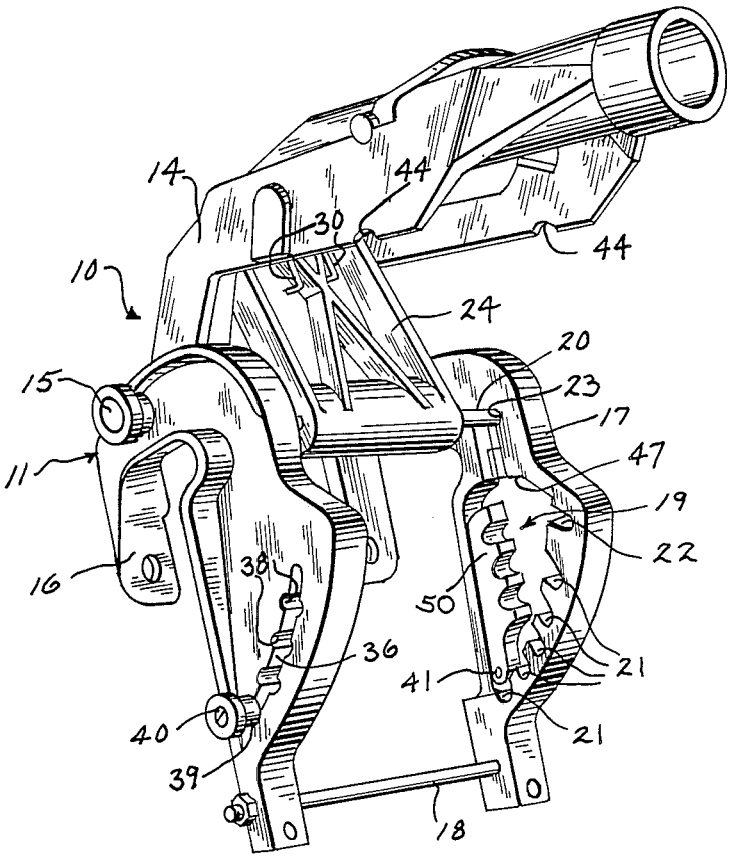
FIG. 1 is a perspective view of the tilt mechanism of the present invention.
Figure 2:
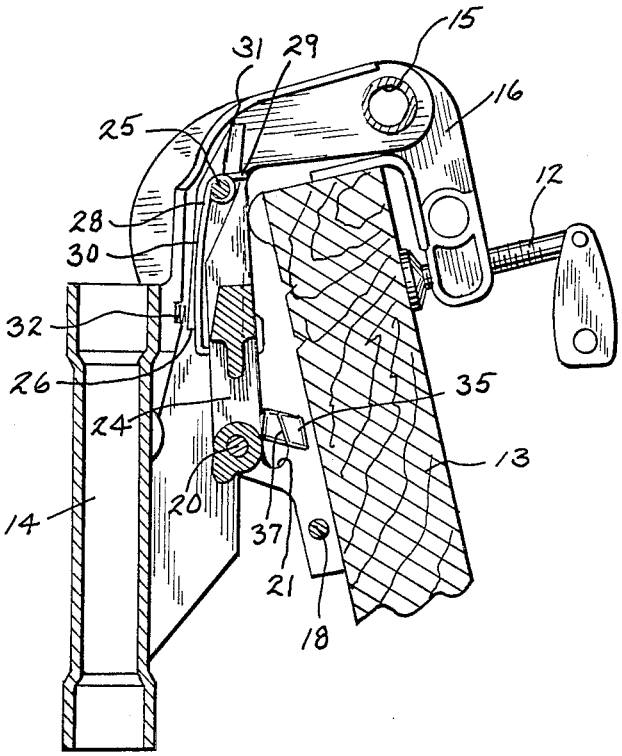
FIG. 2 is a sectional side elevation of the tilt mechanism of FIG. 1 set in a lower trim position.
Figure 3:
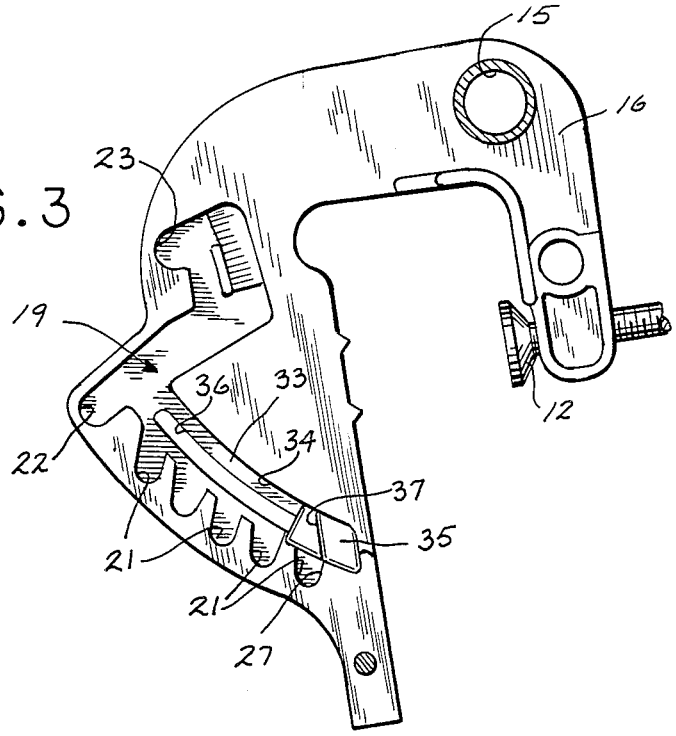
FIG. 3 is a side elevation view of the port side clamp bracket of the tilt mechanism shown in FIG. 1.

In the drawing, a tilt mechanism 10 for an outboard motor includes a transom bracket 11 having a pair of clamps 12 for attachment to the transom 13 of the boat. A swivel bracket 14 is pivotally attached to the transom bracket by a pivot tube 15 for rotation about a generally horizontal axis. An outboard drive unit (not shown) is mounted on the swivel bracket 14 in a conventional manner for tilting movement with the swivel bracket about the horizontal axis of the pivot tube 15. The transom bracket 11 includes port and starboard clamping members 16 and 17 held in a spaced relationship by the pivot tube 15 and a lower tubular cross member 18. The clamping members 16 and 17 have generally similar oppositely facing cam slots 19 adapted to receive the ends of a trim pin 20 and hold the trim pin in one of a series of positions. The slots 19 in the clamping members 16 and 17 each has corresponding notches, including a lower range of trim position notches 21, a shallow water drive notch 22, and an uppermost trailering notch 23. The notches 21, 22 and 23 are disposed in a generally circumferentially spaced pattern about the axis of the pivot tube 15.

The trim pin 20 is carried in the cam slots 19 in clamping members 16 and 17 by a trim pin carrier 24 pivotally attached to the swivel bracket 14 by a pivot rod 25 for rotation about a second generally horizontal axis parallel to the axis of the pivot tube 15. The trim pin 20 is mounted on the lower free end of the trim pin carrier 24. The trim pin carrier is biased to a neutral position such that the trim pin 20 is normally disposed in the cam slots 19 out of engagement with the notches 21 and 22. A torsional pawl spring 28 on the trim pin carrier 24 provides a sternward bias force tending to move the trim pin carrier about the axis of the rod 25 toward the swivel bracket 14 and the notches 21, 22 and 23. The pawl spring 28 is mounted on the pivot rod 25 and includes a center portion 29 bearing against the center flange of the swivel bracket 14 and a pair of legs 30 each having a spiral portion 31 wrapped around the pivot rod 25 and a free hook end engaging the surface of the trim pin carrier 24. The bias of the pawl spring 28 is counteracted by a compression spring 32 disposed between the trim pin carrier 24 and the swivel bracket 14. Preferably, one end of the compression spring 32 is attached to the swivel bracket 14 and the other end bears against a guide arm 26 pivotally attached to the pivot rod 25 for limited rotation with and relative to the trim pin carrier 24. The compressive force of compression spring 32 holds the guide arm 26 in engagement with the trim pin carrier 24 and thus provides a counterbias to the pawl spring 28. Because it is somewhat difficult to select and install a pawl spring 28 and compression spring 32 which will establish and maintain a true neutral bias position for the trim pin 20 along the full range of the notches 21 and 22, it is preferable to utilize a compression spring 32 which provides a force just sufficient to overcome the bias of the pawl spring 28.

Figure 4:
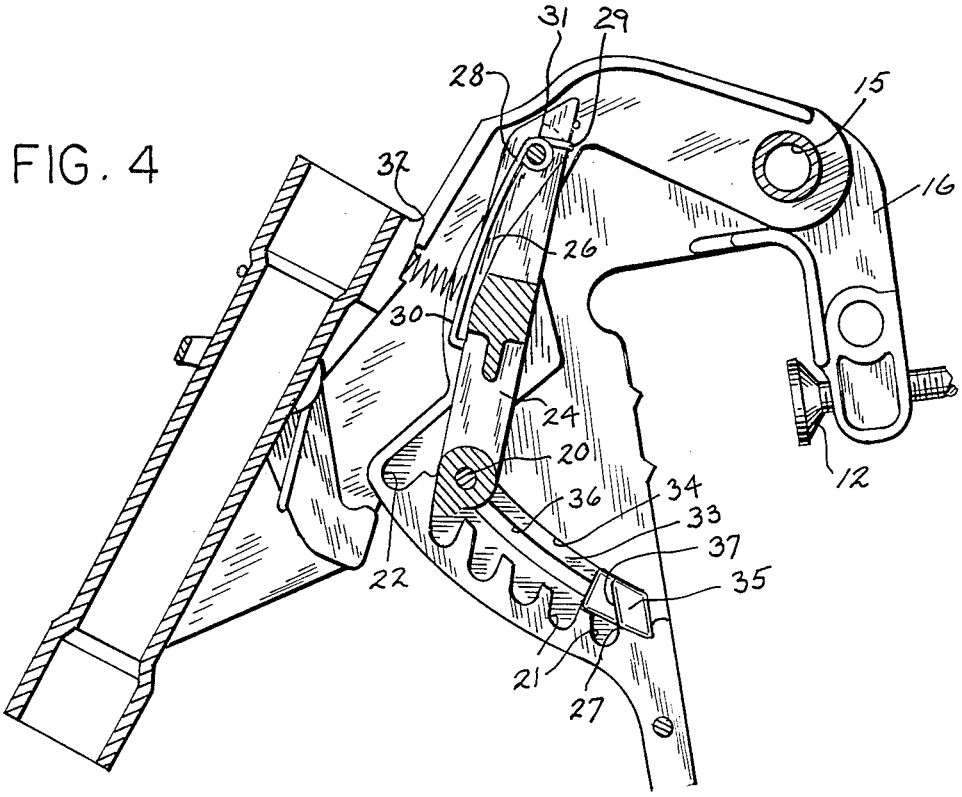
FIG. 4 is a side elevational view in section of the tilt mechanism of FIG. 1 showing the neutral bias return position.

Referring particularly to FIG. 4 showing the inside face of the port clamping member 16, the cam slot 19 comprises a cam track 33 defined generally by a cam surface 34 and the notches 21 and 22. The slight overbias provided by compression spring 32 maintains the trim pin 20 in engagement with the cam surface 34 and out of engagement with the notches 21 or 22 in any position of the swivel bracket 14 between the lowermost trim position notch 21 and the upper shallow water drive notch 22.

To allow the operator to select and preset an operating trim position, an adjustable trim position stop 35 is provided. The stop operates in a slot 36 in the cam track 33 between the notches 21, 22 and the cam surface 34. The trim position stop 35 is movable in the slot 36 and selectively positionable to direct the trim pin into one of the notches 21 or 22 in response to rotation of the swivel bracket 14 and the attached trim pin carrier 24 in a downward direction about the axis of the pivot tube 15. The trim position stop 35 includes a guide surface 37 which is aligned with the lowermost base portion 27 of the notch 21 or 22 at which the trim position stop 35 is located. A knob 39 on the outside face of the starboard clamping member 16 is attached to the trim position stop 35 by a screw 40 extending through the slot 36. The knob 39 is biased toward the clamping member 16 by a coil spring supported on the screw 40 between the screw head and the knob 39. The knob 39 is adapted to engage one of the five blind holds 38 formed along the slot 36 on the outside face of the clamping member 16. The trim position stop 35 can be selectively positioned adjacent any one of the trim position notches 21.

The cam slot 19 on the inside face of the starboard clamping member 17 contains a trim ratchet 50 which is rotatable in the cam slot 19 about a pivot pin 41 between a substantially vertically disposed inoperative position and a downwardly rotated operative position in engagement with the trim pin 20 and the notches 21 and 22. The position of the trim ratchet 50 is controlled by a ratchet lever 42 attached to the pivot pin 41 on the outer face of the starboard clamping member 17. The trim ratchet 50 is spring biased downwardly toward its operative position but is normally retained in its upstanding inoperative position by a detent 43 on the outer face of the clamping member 17, which detent is engageable by the ratchet lever 42. Manual release of the ratchet lever 42 from its engagement with the detent 43, by slight outward movement of the upper end of the ratchet lever, will cause the trim ratchet to rotate downwardly about the pivot pin 41 and into spring biased engagement with the notches 21 and 22, as best shown in FIG. 8.

In operation, the trim position stop 35 is moved into operative position with respect to one of the trim position notches 21 as shown, for example, in FIG. 4. As the swivel bracket 14 is rotated downwardly, the trim pin 20 in the trim pin carrier 24 also moves downwardly in the cam track 33 along the cam surface 34. When the trim pin comes into engagement with the guide surface 37 on the trim position stop 35, the guide surface directs the pin 20 into the notch 21. The swivel bracket 14 includes two notched abutments 44, one on each side, which rest against the trim pin 20 when the pin is engaged with any of the trim position notches 21 or the shallow water drive notch 22. Engagement between the notched abutments 44 and the trim pin 20 is normally maintained by the weight of the motor and/or the forward thrust generated by the motor. Under these conditions, the swivel bracket 14 and attached motor will normally remain in the selected trim position, but may be subject to tilt-up by certain temporary or inadvertant occurrences, such as trailout resulting from rapid deceleration, intentional tilt up due to too shallow water, or tilt up as a result of the operator inadvertantly pushing down on the motor tiller handle. Under any of these occurrences, it is normally desired or desirable to have the motor returned to the originally selected trim position. Because the trim pin 20 is biased to run in the cam track 33 without engaging any of the notches 21 or 22, inadvertant or brief tilt-up of the motor will not cause the trim pin to engage any of the notches 21 or 22 above the selected set position controlled by the trim position stop 35. In addition, the motor may be returned from such temporary tilt-up by direct downward return rotation and reengagement of the trim pin 20 with the guide surface 37 to direct the trim pin back into the preselected trim position notch 21.

Figure 7:
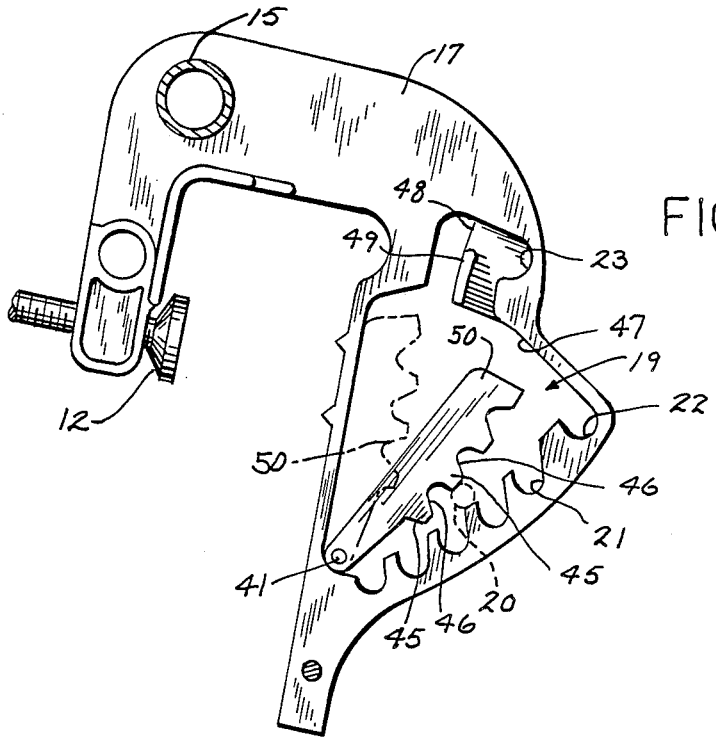
FIG. 7 is a side view of the starboard clamp bracket of the tilt mechanism shown in FIG. 6.
Figure 8:
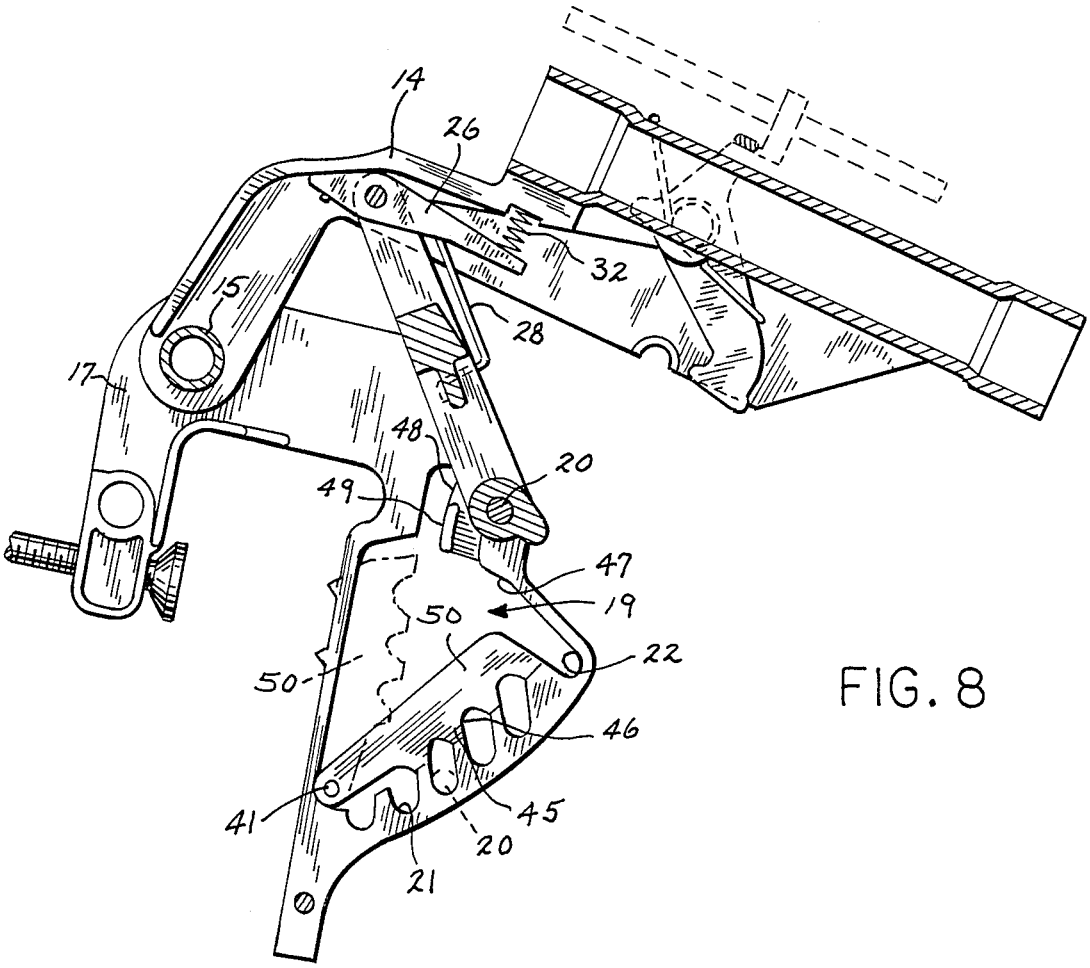
FIG. 8 is a sectional side elevation of the tilt mechanism showing the uppermost trailering position.

Should the operator desire to temporarily tilt the engine to and hold it at a higher position, the trim ratchet 50 is released from its inoperative position by operation of the ratchet lever 42 and allowed to rotate down under the force of its bias spring into engagement with the upper edges of the notches 21 and 22, as shown in FIG. 8. If the engine is then tilted up, as by pushing down on the tiller handle, upward movement of the trim pin 20 out of the notch 21 will force the trim ratchet to pivot upwardly, as shown in FIG. 7, until the pin passes the adjacent ratchet tooth 45 at which point the ratchet will again rotate downwardly under the force of its bias spring. If the motor is released at that point, the face 46 of the ratchet tooth 45 which the trim pin 20 has just passed will act in the same manner as the guide surface 37 and guide the trim pin into that notch. However, continued upward tilting of the motor will allow it to be sequentially ratcheted to any higher trim position established by the trim position notches 21 or the shallow water notch 22. When the operator desires to return the motor to the original preset trim position, established by location of the trim position stop 35, the ratchet lever 42 is rotated upwardly, carrying the trim ratchet 50 with it, into engagement with the detent 43 to hold it in an inoperative position. Slight tilt-up of the motor releases the trim pin 20 from the notch, allows it to be biased into its neutral position in the cam track 33, whereby further downward movement returns it directly to the position set by the trim position stop 35.

Figure 5:
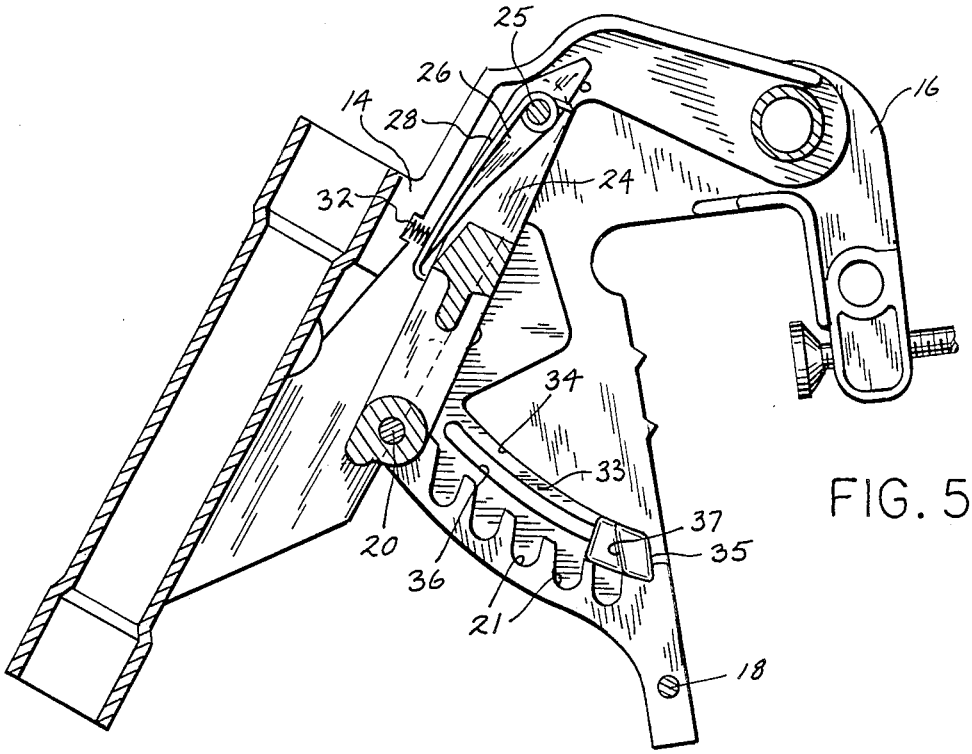
FIG. 5 is a sectional side elevation similar to FIG. 4 showing the upper trim or shallow water position of the mechanism.
Figure 6:
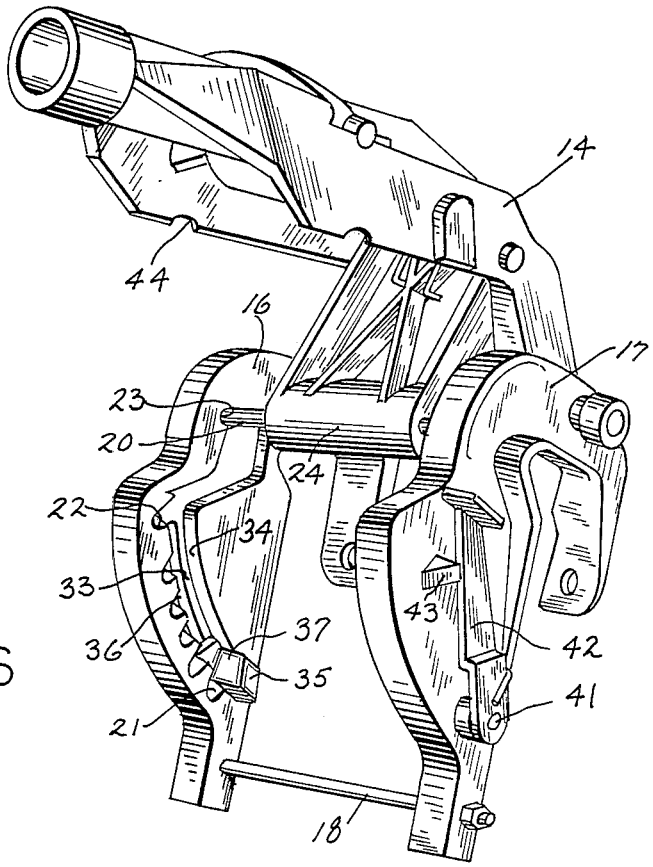
FIG. 6 is a perspective view of the tilt mechanism taken from the side opposite that shown in FIG. 1.

The tilt mechanism of the present invention may also conveniently utilize the prior art subassembly for raising the swivel bracket 14 and the motor to the uppermost trailering position with the trim pin 20 in engagement with the trailering notch 23. Referring particularly to FIGS. 5 and 8, upward rotation of the swivel bracket 14 will result in the corresponding rotation of the trim pin carrier 24 and trim pin 20 past the cam surface 34 and the shallow water drive notch 22 until the trim pin engages the sternward wall 47 of the cam slot 19. Engagement between the trim pin and the sternward wall 47 will temporarily prevent continued rotation of the trim pin carrier 24 with the upward rotation of the swivel bracket 14. However, guide arm 26 remains free to rotate with the swivel bracket and away from the trim pin carrier 24. Continued upward rotation of the swivel bracket 14 relative to the trim pin carrier 24 will result in disengagement between the guide arm 26 and the trim pin carrier 24. Such disengagement temporarily eliminates the neutral bias of the compression spring 32 and results in the trim pin carrier and trim pin being biased against the sternward wall 47 under the influence of the pawl spring 28 (tending to rotate the trim pin carrier counterclockwise in FIG. 8). As the swivel bracket 14 is continued to be rotated upwardly, the trim pin 20 will eventually reach the upper end of the sternward wall 47 and, under the bias of the pawl spring 28, move into engagement with the trailering notch 23, as shown. Disengagement of the trim pin from the trailering notch 23 is accomplished by slight upward movement of the swivel bracket 14, axial displacement of the trim pin 20 as it moves over the step 48, and return movement past the return cam surface 49. This operation is described in more detail in U.S. Pat. No. 4,472,148 and forms no part of the present invention, apart from disengagement of the neutral bias provided by compression spring 32 which allows conventional operation of the trailering subassembly. In addition, release of the trim pin from the trailering notch 23 also allows direct downward return of the assembly to the original position of the trim pin stop 35 in the manner previously described.

Various modes of carrying out the invention are contemplated as being within the scope of the following claims particularly pointing out and distinctly claiming the subject matter which is regarded as the invention.

I claim:

1. A tilt mechanism for a marine propulsion device comprising:

a. a transom bracket for attachment to a boat, said transom bracket having a cam track including a plurality of notches circumferentially spaced about a first generally horizontal axis;

b. a swivel bracket pivotally attached to the transom bracket for rotation about the first horizontal axis;

c. a pawl assembly having one end pivotally attached to the swivel bracket for rotation about a second generally horizontal axis, said pawl assembly having a second end movable along the cam track into engagement with said notches to provide a series of angular positions for the swivel bracket;

d. adjustable guide means attached to the transom bracket and movable along the cam track for selectively directing the second end of said pawl assembly into engagement with one of said notches in response to rotation of the swivel bracket in a downward direction about the first horizontal axis;

e. means for biasing the second end of the pawl assembly to a neutral position on the cam track out of engagement with said notches to allow upward rotation of the swivel bracket past said notches and direct downward return rotation of the swivel bracket for reengagement of the second end of said pawl assembly with the one of said notches; and, f. ratchet means attached to the transom bracket for movement between an inoperative first position and a second position operatively engaging the second end of said pawl assembly and said notches for sequentially directing the second end of said pawl assembly into engagement with said notches in response to rotation of the swivel bracket in an upward direction.

2. The tilt mechanism as defined in claim 1 wherein said pawl assembly comprises a trim pin carrier including a trim pin attached to the second end thereof, said trim pin extending generally parallel to the first and second axes and having an end portion adapted to engage said cam track and said notches.

3. The tilt mechanism as defined in claim 2 wherein the means for biasing the second end of the pawl assembly to a neutral position comprises first and second spring means acting in opposition to one another.

4. The tilt mechanism as defined in claim 3 wherein the first spring means comprises a pawl spring operative to bias the trim pin carrier toward the swivel bracket and said notches, and the second spring means comprises a compression spring disposed between the trim pin carrier and the swivel bracket operative to counteract the bias of the pawl spring when the trim pin is on the cam track.

5. The tilt mechanism as defined in claim 4 including a cam track extension on the transom bracket above the uppermost of said plurality of notches, said cam track extension having a trailering notch for receiving the trim pin as the swivel bracket and trim pin carrier are rotated in an upward direction, a cam surface on the cam track extension adjacent the trailering notch engageable by the trim pin and operative in response to upward rotation to disengage said compression spring, whereby the trim pin is biased into the trailering notch.

6. The tilt mechanism as defined in claim 2 wherein the ratchet means is pivotally attached to the transom bracket for rotational movement about a third generally horizontal axis.

7. The tilt mechanism as defined in claim 6 wherein the ratchet means is spring biased into operative engagement with said notches and said trim pin.

* * * * *